US007672471B1

(12) United States Patent
Kalomirakis et al.

(10) Patent No.: US 7,672,471 B1
(45) Date of Patent: Mar. 2, 2010

(54) LIGHT BULB LOUDSPEAKER AND SOUND SYSTEM

(76) Inventors: Theo Kalomirakis, 535 Dean St., BH 101, Brooklyn, NY (US) 11217; Clifford Kraft, 320 Robin Hill Dr., Naperville, IL (US) 60540

( * ) Notice: Subject to any disclaimer, the term of this patent is extended or adjusted under 35 U.S.C. 154(b) by 352 days.

(21) Appl. No.: 11/283,497

(22) Filed: Nov. 18, 2005

Related U.S. Application Data

(60) Provisional application No. 60/630,914, filed on Nov. 24, 2004.

(51) Int. Cl.
*H04R 25/00* (2006.01)

(52) U.S. Cl. ..... 381/386; 381/394

(58) Field of Classification Search ..... 381/386, 381/388, 394, 396; 340/310.12; 84/464 R; 310/358
See application file for complete search history.

(56) References Cited

U.S. PATENT DOCUMENTS

| | | | | |
|---|---|---|---|---|
| 3,948,466 | A | 4/1976 | Rudder et al. | |
| 3,964,693 | A | 6/1976 | Thomas | |
| 3,985,316 | A | 10/1976 | Weissmuller | |
| 4,059,246 | A | 11/1977 | Anders et al. | |
| 4,135,684 | A | 1/1979 | Willey | |
| 4,251,169 | A | 2/1981 | Kelley et al. | |
| 4,315,704 | A | 2/1982 | Kelley et al. | |
| 4,339,228 | A | 7/1982 | Kelley et al. | |
| 4,352,603 | A | 10/1982 | Anders | |
| 4,367,426 | A * | 1/1983 | Kumada et al. | 310/358 |
| 4,462,721 | A | 7/1984 | Anders et al. | |
| 4,482,294 | A | 11/1984 | Kelley et al. | |
| 4,512,688 | A | 4/1985 | Hochradel | |
| 4,540,317 | A | 9/1985 | Vogel | |
| 4,710,098 | A | 12/1987 | Anders et al. | |
| 4,715,750 | A | 12/1987 | Podoll et al. | |
| 4,792,263 | A | 12/1988 | Podoll | |
| 4,811,313 | A * | 3/1989 | Tse | 369/6 |
| 4,930,941 | A | 6/1990 | Willey et al. | |
| 4,971,481 | A | 11/1990 | Foreman | |
| 4,984,939 | A | 1/1991 | Foreman et al. | |
| 5,127,773 | A | 7/1992 | Foreman et al. | |
| 5,131,792 | A | 7/1992 | Grosswiller et al. | |
| 5,181,806 | A | 1/1993 | Grosswiller et al. | |
| 5,209,609 | A | 5/1993 | Lang | |
| 5,299,891 | A | 4/1994 | Grosswiller et al. | |
| 5,562,367 | A | 10/1996 | Scott | |
| 5,735,644 | A | 4/1998 | Grosswiller et al. | |

(Continued)

*Primary Examiner*—Tuan D Nguyen
(74) *Attorney, Agent, or Firm*—Clifford Kraft

(57) ABSTRACT

A light bulb loudspeaker and sound system where a wireless or wire receiver, amplifier and power supply can be mounted inside of the boundary defined by a light bulb and base where the glass bulb can be used as a sound radiating diaphragm, or alternatively, the bulb can be made to move as a plunger and this act as a sound diaphragm. A transducer can convert audio from the amplifier into sound and thereby excite the glass bulb or cause it to move. A baffle can optionally be provided in the form of a lamp shade or otherwise. Different channels can provide different audio signals to different light bulb loudspeakers in the same physical area, or an electrical signal could be multiplexed. A small base station unit can transmit radio or wire signals containing audio information from an audio source such as a stereo. The filament can optionally be used as a radio receiving antenna.

5 Claims, 7 Drawing Sheets

U.S. PATENT DOCUMENTS 5,816,443 A 10/1998 Bustos
6,039,510 A 3/2000 Greene et al.
6,146,057 A 11/2000 Gromley et al.

* cited by examiner

LIGHT BULB LOUDSPEAKER AND SOUND SYSTEM

This application is related to and claims priority from U.S. Provisional Patent application No. 60/630,914 filed Nov. 24, 2004. Application 60/630,914 is hereby incorporated by reference.

BACKGROUND

1. Field of the Invention

The present invention relates generally to the field of sound systems and more particularly to a light bulb loudspeaker and sound system.

2. Background of the Invention

Loudspeakers have been on lamp stems and in housings that also contain light bulbs. Local and wrap-around sound is known in the art to require distributed loudspeakers. Loudspeakers, in general, require amplifiers that must be powered. Remote wireless loudspeakers are known in the art; however, these must be plugged into AC power, are unsightly and need to be placed somewhere for optimum sound distribution.

It would be advantageous to have a loudspeaker that also functions as a light bulb that can be optionally screwed into a light socket and radiate sound by vibration of the glass envelope of the bulb itself or by motion of the bulb. Such a loudspeaker could work either un-baffled or could use some furniture item such as a lamp shade as a sound baffle or have a small baffle around the light. This light bulb loudspeaker could operate wirelessly to receive modulated audio signals from a wireless base station (attached to a sound source such as a stereo) or could receive audio information by wire such as over the power line or other wire. The entire circuitry of the wireless receiver, amplifier, power supply and transducer could fit entirely inside the light bulb or the base of the bulb or in proximity to it.

SUMMARY OF THE INVENTION

The present invention relates to a light bulb loudspeaker and sound system that can contain a signal receiver optionally with a receiving antenna for receiving a signal that contains audio information, an amplifier electrically coupled to the receiver for amplifying the audio information, a transducer electrically coupled to the amplifier for converting the audio information to sound where the transducer can be mechanically coupled to a glass or plastic bulb. The glass or plastic bulb can also contain a standard incandescent light producing filament or the bulb can be a fluorescent tube. Any type of light generator and any type of bulb is within the scope of the present invention. The light bulb can optionally have a standard base for coupling the light bulb loudspeaker into a conventional electric power source or can have a special base. The signal receiver, amplifier and transducer can be mounted inside a boundary defined by the glass bulb and the base or separately.

The light bulb sound system can contain a power supply mounted within the boundary for converting conventional electric power to DC to power the signal receiver and the amplifier. A radio receiving antenna or a wireless embodiment can be the light producing filament itself or a separate antenna. Sound could also be transmitted to the bulb over the 110 volt or other voltage supply lines or over any wire.

A wireless embodiment of the light bulb loudspeaker or sound system can operate on an unlicensed ISM radio frequency band and can be allowed to receive one of several different radio or electrical signals, each containing different audio information. Different bulbs on a string, for example, could play different part of a piece of music.

The light bulb loudspeaker can also have an optional baffle exterior to its boundary where the baffle can act as a lamp shade. It is also possible to simply have a baffle partially surround the bulb or take any other configuration.

Several drawings and illustrations have been presented to aid in the understanding of the present invention. The scope of present invention is not limited to what is shown in the figures.

DETAILED DESCRIPTION OF THE INVENTION

A wireless loudspeaker can be built to fit and operate entirely inside an incandescent lamp or common light bulb or in a fluorescent tube or any other type of bulb. Such a light bulb could optionally screw into any standard light socket and operate exactly as any other light bulb. It can be made in standard light power ranges of 40 watts, 60 watts, 100 watts and any other size, or it can be a fluorescent tube or any other type of light.

Figure 1:
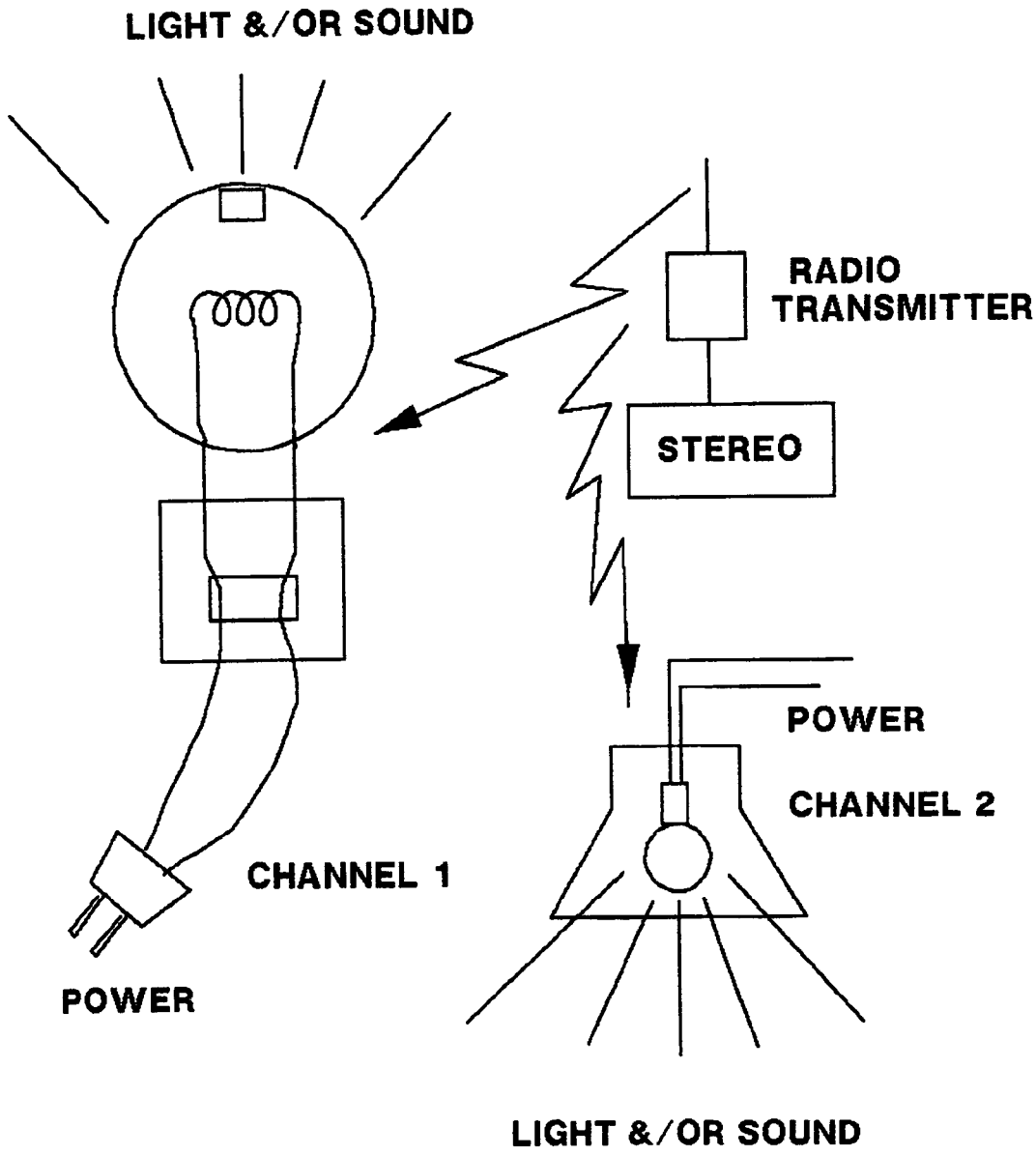
FIG. 1 shows several wireless light bulb loudspeakers operating in conjunction with a stereo system.

FIG. 1 shows an arrangement of a stereo system transmitting wireless modulated audio signals to one or more light bulb loudspeakers. Transmission can take place on the license-free ISM bands at 900 MHz, 2.4 GHz or 5.8 GHZ or on other frequencies. Different modulation, multiple access, or multiplexing can be optionally used in the present invention to allow a single sound source to transmit different sound signals to different light bulbs. A small base station transmitter unit can transmit to several different light bulb loudspeakers. Any common modulation technique can be used including AM, FM, phase, pulse, spread spectrum under any standard such as Bluetooth, or any other 801.2 type standard is within the scope of the present invention as well as any wire transmission technique including power line transmission. While any radio frequency is within the scope of the present invention for a wireless embodiment, the preferred band is 5.8 GHz. This is because of the small size of a receiving antenna, and the lack of other radio frequency interference in this band. While the preferred method is to use a wireless technique, it is also within the scope of the present invention to use power line communications techniques or other wire techniques known in the art.

Figure 2:
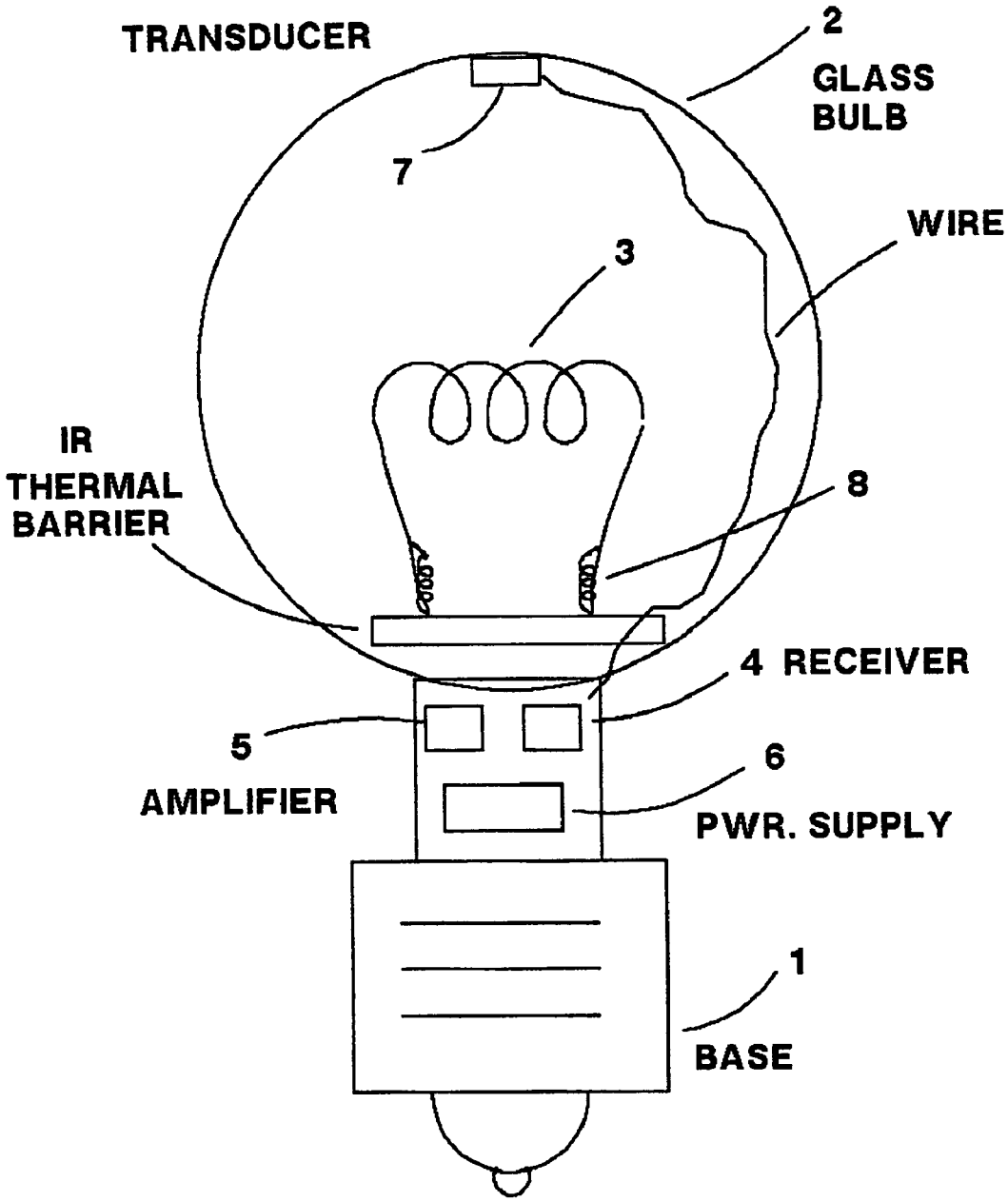
FIG. 2 shows a side view of a light bulb loudspeaker.

FIG. 2 shows a side view of a standard light bulb embodiment of the present invention where the different parts of the light bulb loudspeaker can be seen. A standard base 1 screws into any light socket (while a standard base is preferred, any type of base can be used). A glass bulb 2 with a standard tungsten (or other material) filament 3 can be assembled in the manner of a normal incandescent light bulb.

Electronics, including a wireless receiver 4, an amplifier 5 and a power supply 6 can be mounted in the base of the light bulb or anywhere convenient. Heat produced by the filament should generally not be allowed to overheat the electronic circuitry. Both infrared radiation and thermal conduction should be controlled. At the temperature of most incandescent lamp filaments, infrared radiation is normally the most important source of circuit heating. A reflective IR barrier can optionally be used between the bulb area and the electronics. While a barrier is preferred, any other method of preventing electronics heating is within the scope of the present invention. In addition, a thermal conduction barrier can be used in mounting the electronics to reduce conducted heat.

An audio signal can be coupled from the amplifier 5 and a transducer 7 that can be mechanically coupled to the glass bulb. This transducer 7 can be a piezoelectric crystal transducer, or any other transducer capable of mechanically exciting the glass bulb. Optionally the bulb can be excited in a plunger fashion by causing it to vibrate longitudinally.

For direct bulb excitation, the optimum place to couple the transducer 7 is in the top center of the bulb 2. This causes the most symmetric excitation of the glass and minimizes higher order vibration modes. Some peak compression of the audio signal may be needed to avoid shattering of the bulb during very loud excursions from the audio source. This is optional; any compression or clamping technique to prevent shattering is within the scope of the present invention.

The wireless receiver 4 needs a receiving antenna. While any ungrounded metal can be used, the preferred method is to use the lamp filament as an antenna. To prevent high frequency signals from being shorted out by the low impedance 120 volt power leads, series inductors 8 can be used to provide high impedance blocking at the operating radio frequency, yet pass the low frequency AC power to the filament unimpeded.

Figure 3:
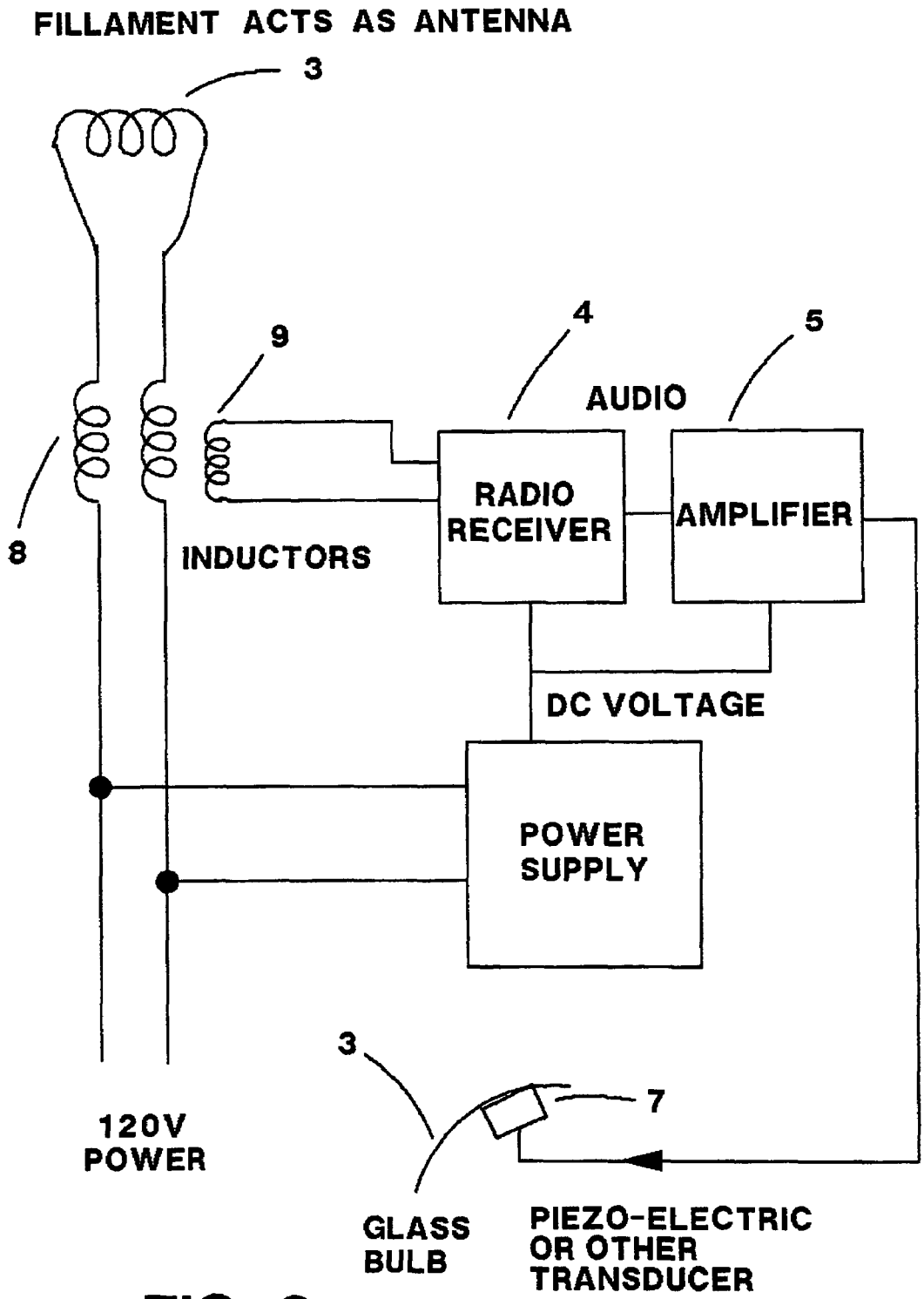
FIG. 3 shows a block diagram of the circuitry of a wireless light bulb loudspeaker.

FIG. 3 shows a block/schematic diagram of an embodiment of the present invention. The filament 2 can act as both a standard light generator and a receiving antenna. Radio signals are coupled from the filament 2 into the wireless receiver 4 through either blocking capacitors or, as shown in FIG. 3, through transformer tap windings 9 on the series inductors 8. Demodulated audio signals can be supplied from the wireless receiver 4 to an audio amplifier 5. The output of the audio amplifier 5 can be delivered to the transducer 7 which mechanically excites the glass bulb 2.

Figure 4A:
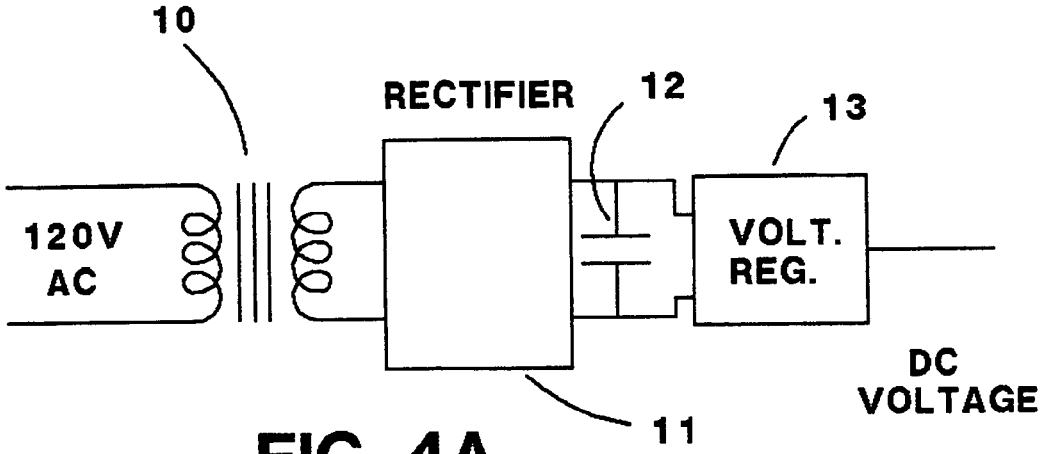
FIGS. 4A and 4B show schematic diagrams of two possible power supplies for the amplifier and wireless unit.
Figure 4B:
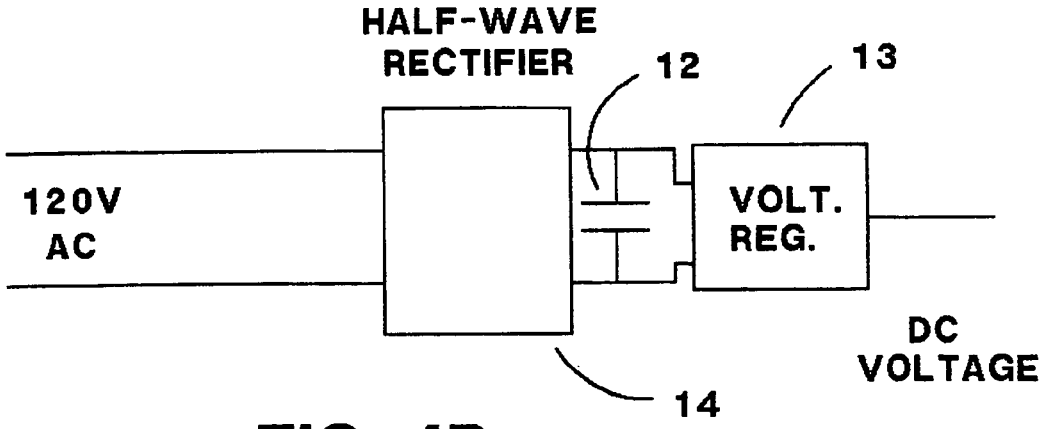

FIGS. 4A and 4B show two different embodiments of power supplies suitable for use in a light bulb loudspeaker. FIG. 4A shows a miniature power transformer 10 that drops the 120 VAC to around 15 VAC (or any other convenient AC voltage from any source AC voltage) for rectification by a full wave, half wave or bridge rectifier 11 preferably containing diodes. The rectified current can be filtered with a capacitor 12 and supplied to a voltage regulator 13 that can contain a zener diode or other means for regulation. It is also within the scope of the present invention to use miniature DC-DC converters known in the art. FIG. 4B is similar to FIG. 4A except that no transformer is used. A half-wave rectifier 14 directly converts 120 VAC to direct current. A voltage regulator then converts this to a usable DC voltage level after filtering. A DC-DC converter can be used for this purpose or any other means of changing the level of DC voltages.

Figure 5:
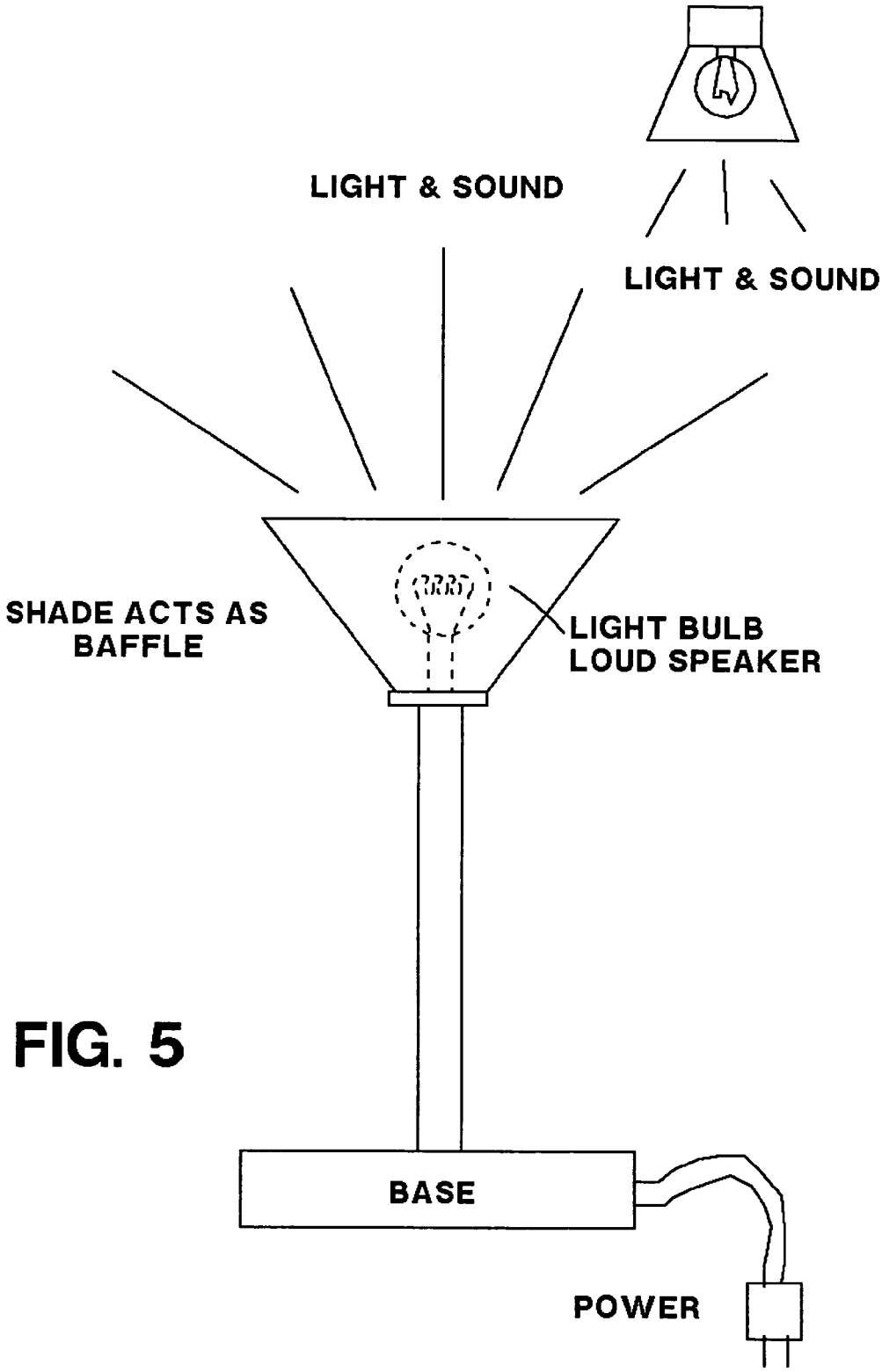
FIG. 5 shows an embodiment of the present invention used with a lamp shade baffle.

FIG. 5 shows an embodiment of the present invention being used with a lamp shade baffle below (or alternatively above) the light bulb loudspeaker. While it is entirely possible to use the loudspeaker of the present invention without a baffle, much better sound quality and directionality can normally be achieved through the use of a baffle. A lamp shade or reflector is normally shaped correctly to act as a baffle. Any type of baffle is within the scope of the present invention.

Because of the small size of the sound radiating diaphragm (namely the glass bulb), the light bulb loud speaker of the present invention cannot generally radiate high amplitude low frequency sounds. It may be therefore desirable, when low frequencies are desired, to also use a low frequency loud speaker (such as a woofer or sub-woofer) mounted or placed somewhere in proximity to the bulb or bulbs. It is entirely possible to use the light bulb loudspeaker of the present invention outdoors (or indoors) to provide "musical lights". Such lights can be used to enhance holiday decorations, etc. without the need for separate loudspeakers for music.

Some models of the present invention can simply be turned off when the light is turned off. However, it is desirable that the loud speaker function also work when the light bulb is turned off. An embodiment of the present invention uses a base with three electrical contacts instead of two where one of the contacts always provides power to the electronics and the other provides power to the lamp that can be turned off and on. Another embodiment of the present invention contains an internal switch that shuts the lamp off under radio or wire command control without shutting off the loud speaker electronics. Any other method of shutting off the lamp without also shutting off the loudspeaker electronics is within the scope of the present invention.

Figure 6A:
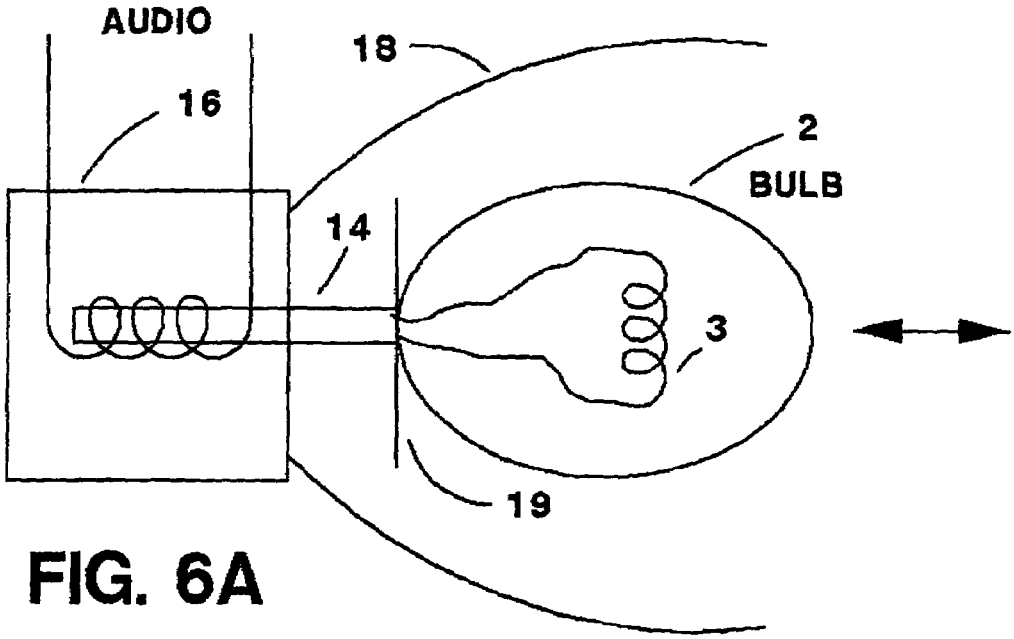
FIG. 6A shows a plunger type embodiment of the present invention with a metal stem.

An alternate embodiment of the present invention causes the light bulb to operate as a plunger on a piston to produce sound. Turning to FIG. 6A, it can be seen that the receiver is located in a base 16. An electromagnetic coil 17 or other driver can be co-located in the base. A metal stem 14 can be attached to the light bulb and arranged so that the stem runs through the electromagnetic coil 17 in the base. The metal stem can be optionally magnetized. Amplified audio current is normally supplied to the coil so that it produces a changing magnetic field that represents the sound to be produced. The time-varying magnetic field in the coil causes the stem to act like a piston and to move in and out of the coil in a manner proportional to the magnetic field and hence representative of the desired sound. The stem 14 causes the entire light bulb 2 to move back and forth longitudinally acting as a diaphragm. Air molecules displaced by the bulb produce sound in a manner known in the art. An optional sound reflector or baffle 18 can surround the bulb to cause the sound wave to be somewhat directional, and hence of higher amplitude. A optional small disk 19 around the base of the bulb can also help capture more air and produce a louder sound, especially at lower frequencies. The plunger embodiment shown in FIG. 6A works on a principle similar to that of a conventional loudspeaker with the light bulb itself replacing the paper diaphragm of the loud speaker.

Figure 6B:
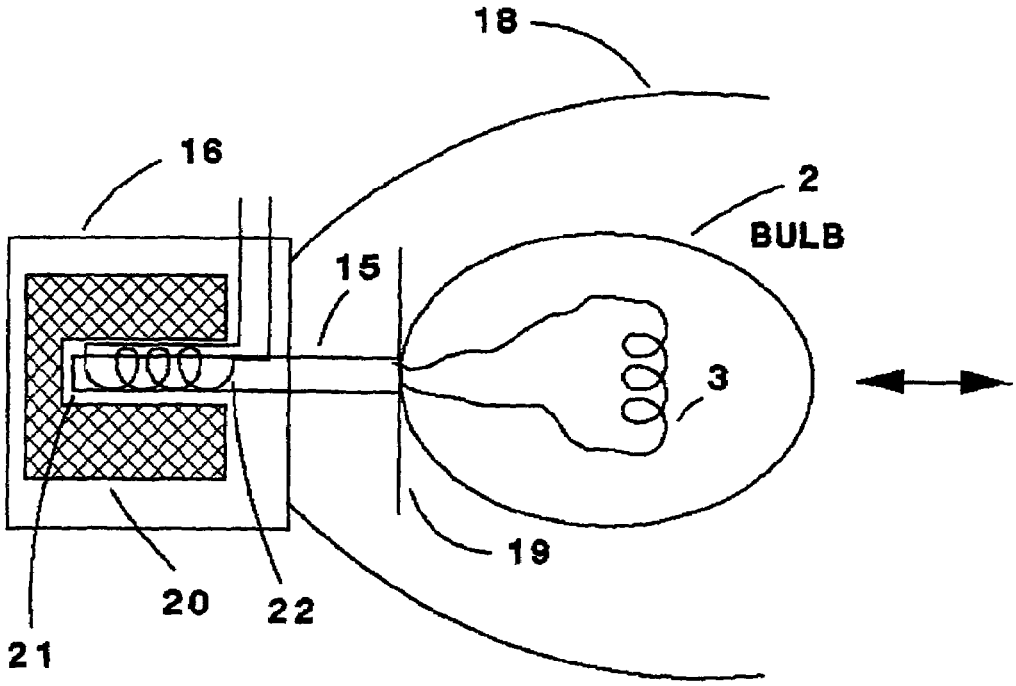
FIG. 6B shows a plunger type embodiment of the present invention with a permanent magnet.

Another embodiment shown in FIG. 6B uses a permanent magnet 20 that has a hollow cavity 21 to receive the stem 15 of the light bulb. In this embodiment, the electromagnetic coil 22 is wound on the stem 15 itself. The activated coil 22 on the stem causes the stem 15 to move in and out of the permanent magnet. The resulting plunger motion of the bulb 2 results in audible sound as in the previous embodiment. As in FIG. 6A, an optional baffle 18 may be used. Any mechanical means of causing a plunger action on the bulb is within the scope of the present invention.

Figure 7:
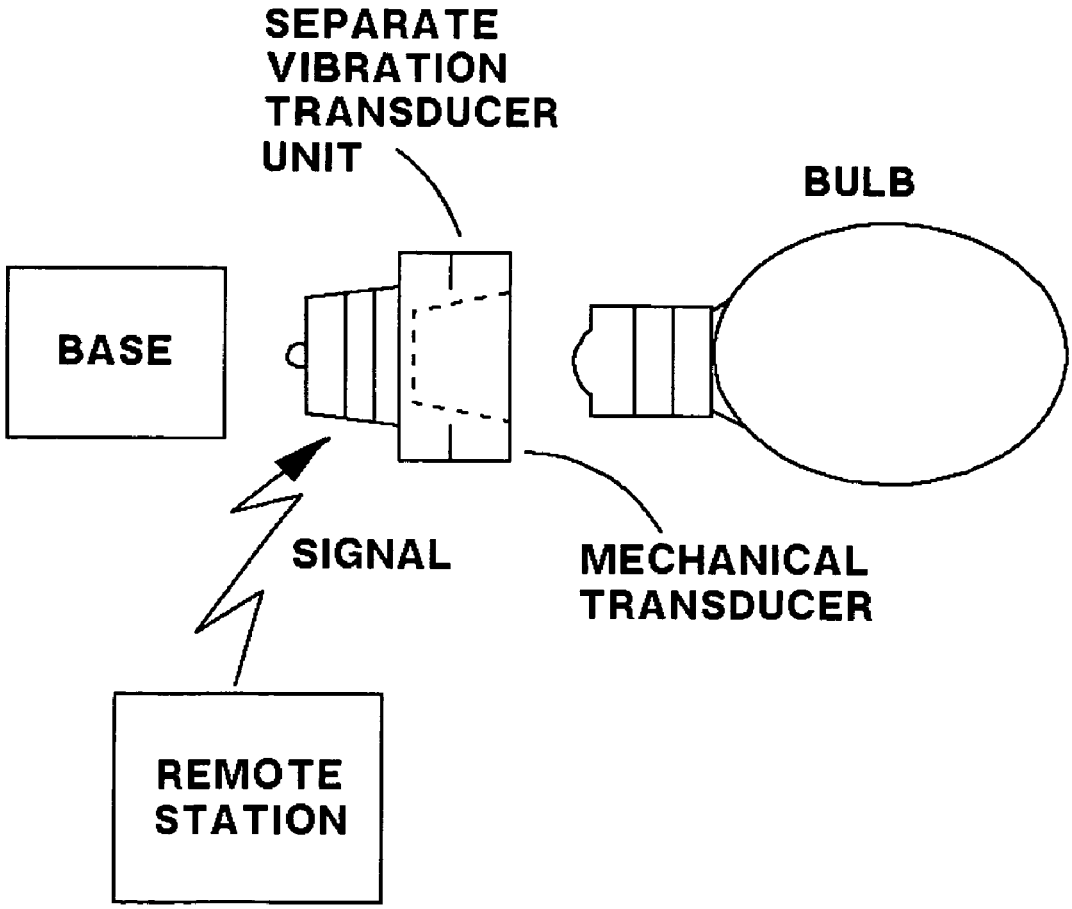
FIG. 7 shows an embodiment that is separate from the light bulb.

In an alternate embodiment of the present invention, the entire sound and vibration assembly can be separate from the light bulb and simply screw in or fit in a light bulb socket. In this embodiment, a light bulb could then screw into the assembly. The assembly could then make the bulb vibrate and act as a diaphragm. An example of this embodiment is shown in FIG. 7.

Several descriptions and illustrations have been provided to better aid in the understanding of the present invention. One skilled in the art will understand that many changes and variations are possible without departing from the spirit of the invention. Each of these changes and variations is within the scope of the present invention.

We claim:

1. A light bulb loudspeaker comprising:

an evacuated glass bulb attached to a base;

an incandescent lamp filament mounted inside said bulb, said incandescent lamp filament wired to an electrical connection point in said base, wherein said lamp filament produces light when an applied voltage is connected to said electrical connection point;

an electromechanical transducer attached to an inside surface of said glass bulb;

a radio receiver located in said base, said radio receiver being in electrical communication with a piezoelectric transducer;

a power supply located in said base, said power supply providing power for said radio receiver from said applied voltage;

a radio transmitter remote from said base, said radio transmitter transmitting music modulated upon a radio frequency carrier to said radio receiver;

wherein said electromechanical transducer excites said glass bulb causing said glass bulb to act as a sound diaphragm playing said music.

2. The light bulb loudspeaker of claim 1 wherein said electromechanical transducer is a piezoelectric transducer.

3. The light bulb loudspeaker of claim 1 wherein said applied voltage is power line voltage.

4. The light bulb loudspeaker of claim 1 wherein said radio transmitter and radio receiver modulate said music using frequency modulation.

5. The light bulb loudspeaker of claim 1 wherein said power supply provides a DC voltage.

* * * * *